US008591708B2

(12) United States Patent
Potchen et al.

(10) Patent No.: US 8,591,708 B2
(45) Date of Patent: Nov. 26, 2013

(54) ELECTROLYTIC CELL AND RELATED METHODS OF MAKING AND USE

(75) Inventors: Robert T. Potchen, Orlando, FL (US); Thomas H. Kaylor, McGregor, TX (US)

(73) Assignee: Michael Jones, Winter Springs, FL (US)

( * ) Notice: Subject to any disclaimer, the term of this patent is extended or adjusted under 35 U.S.C. 154(b) by 220 days.

(21) Appl. No.: 12/997,415

(22) PCT Filed: Mar. 12, 2009 (Under 37 CFR 1.47)

(86) PCT No.: PCT/US2009/036952

§ 371 (c)(1), (2), (4) Date: May 26, 2011

(87) PCT Pub. No.: WO2009/151685

PCT Pub. Date: Dec. 17, 2009

(65) Prior Publication Data

US 2011/0272277 A1 Nov. 10, 2011

Related U.S. Application Data

(60) Provisional application No. 61/131,729, filed on Jun. 12, 2008, provisional application No. 61/088,547, filed on Aug. 11, 2008, provisional application No. 61/188,546, filed on Aug. 11, 2008.

(51) Int. Cl.

| | |
|---|---|
| ***C25B 9/18*** | (2006.01) |
| ***C25B 9/06*** | (2006.01) |
| ***C25B 13/02*** | (2006.01) |

(52) U.S. Cl.

USPC ..... 204/278.5; 204/269

(58) Field of Classification Search

USPC ..... 204/278.5

See application file for complete search history.

(56) References Cited

U.S. PATENT DOCUMENTS

| | | | | |
|---|---|---|---|---|
| 4,339,324 | A * | 7/1982 | Haas | 204/270 |
| 4,344,832 | A * | 8/1982 | Dahlberg | 204/258 |
| 5,186,807 | A * | 2/1993 | Sanford et al. | 204/618 |
| 5,614,069 | A | 3/1997 | Lin | |

(Continued)

FOREIGN PATENT DOCUMENTS

| | | |
|---|---|---|
| DE | 3218259 | 11/1983 |
| EP | 0048559 | 3/1982 |
| WO | 2010/020013 | 2/2010 |

OTHER PUBLICATIONS

European Patent Office: European Search Report dated Aug. 11, 2011, pp. 1-3.

*Primary Examiner* — Harry D Wilkins, III

(74) *Attorney, Agent, or Firm* — Allen, Dyer, Doppelt, Milbrath & Gilchrist, P.A.

(57) ABSTRACT

An electrolytic cell includes a plate stack including a plurality of plates spaced apart to define a plurality of channels extending therebetween, a housing arranged around the plurality of plates, and a plurality of terminals connected to the plate stack for placing an electrical potential thereacross. The cell can also include a plurality of adhesive strips arranged between the plurality of plates and further defining the plurality of channels. A method of making an electrolytic cell includes arranging a manifold section mold having a plurality of openings therein over a plurality of pins, arranging a first end of a plate stack in the mold such that the plurality of pins extend into the plurality of channels, and molding a first manifold section.

8 Claims, 5 Drawing Sheets

(56) References Cited

U.S. PATENT DOCUMENTS

| | | | | |
|---|---|---|---|---|
| 5,756,874 | A * | 5/1998 | Steward | 588/302 |
| 6,264,807 | B1 * | 7/2001 | Fenner et al. | 204/252 |
| 6,596,427 | B1 * | 7/2003 | Wozniczka et al. | 429/435 |
| 7,879,507 | B2 * | 2/2011 | Osenar et al. | 429/513 |
| 7,914,947 | B2 * | 3/2011 | Osenar et al. | 429/535 |
| 2003/0096153 | A1 * | 5/2003 | Osenar et al. | 429/35 |
| 2010/0065419 | A1 * | 3/2010 | Richardson | 204/228.2 |
| 2011/0206960 | A1 * | 8/2011 | Winter | 429/70 |
| 2012/0118731 | A1 * | 5/2012 | Liang et al. | 204/275.1 |

* cited by examiner

ELECTROLYTIC CELL AND RELATED METHODS OF MAKING AND USE

CROSS-REFERENCES TO RELATED APPLICATIONS

The present application is the § 371 National Stage of International Application No. PCT/US09/36952, filed on Mar. 12, 2009, which claims the benefit of U.S. U.S. Provisional Application Ser. No. 61/131,729, filed on Jun. 12, 2008, U.S. Provisional Application Ser. No. 61/188,546, filed on Aug. 11, 2008, and U.S. Provisional Application Ser. No. 61/188,547, filed on Aug. 11, 2008; the contents of which applications are hereby incorporated by reference in their entirety.

FIELD OF THE INVENTION

The present invention relates to electrolysis, and more particularly, to electrolytic cells and related methods of manufacture.

BACKGROUND OF THE INVENTION

Electrolytic cells are widely used for several commercially valuable purposes. Basic components of an electrolytic cell include two or more electrodes, typically plates or rods, separated by an electrolyte. An electrical potential is placed across the electrodes, causing current to flow through the electrolyte resulting in the breakdown of one or more constituent elements thereof.

One important factor affecting the viability of an electrolytic cell is the efficiency with which the cell performs electrolysis. In practice, gains in efficiency are frequently offset by corresponding gains in the cost of producing the electrolytic cell.

SUMMARY OF THE INVENTION

In view of the foregoing, it is an object of the present invention to provide an improved electrolytic cell and associated methods of making and use. According to an embodiment of the present invention an electrolytic cell includes a plate stack including a plurality of plates spaced apart to define a plurality of channels extending therebetween, a housing arranged around the plurality of plates, and a plurality of terminals connected to the plate stack for placing an electrical potential thereacross.

According to an aspect of the present invention, the cell further includes a plurality of adhesive strips arranged between the plurality of plates and further defining the plurality of channels. According to another aspect of the present invention, the housing includes at least one manifold section defining a plurality of manifold openings extending therethrough in communication with the plurality of channels.

According to a method aspect, a method of making an electrolytic cell includes forming a plurality of plates into a plate stack using a plurality of adhesive strips connected therebetween, a plurality of channels being defined between the plates and the adhesive strips, and forming a housing around the plate stack such that at least one opening in the housing communicates with the plurality of channels.

According to a further aspect of the present invention, forming the housing includes arranging a manifold section mold having a plurality of openings therein over a plurality of pins such that the plurality of pins extend through the plurality of openings, arranging a first end of a plate stack in the mold such that the plurality of pins extend into the plurality of channels, filling the manifold section mold with a flowable material, curing the flowable material to form a first manifold section on the first end of the plate stack, and removing the first end of the plate stack and first manifold section from the plurality of pins and the manifold section mold.

These and other objects, aspects and advantages of the present invention will be better appreciated in view of the following detailed description of a preferred embodiment and accompanying drawings.

DETAILED DESCRIPTION OF PREFERRED EMBODIMENTS

Figure 1:
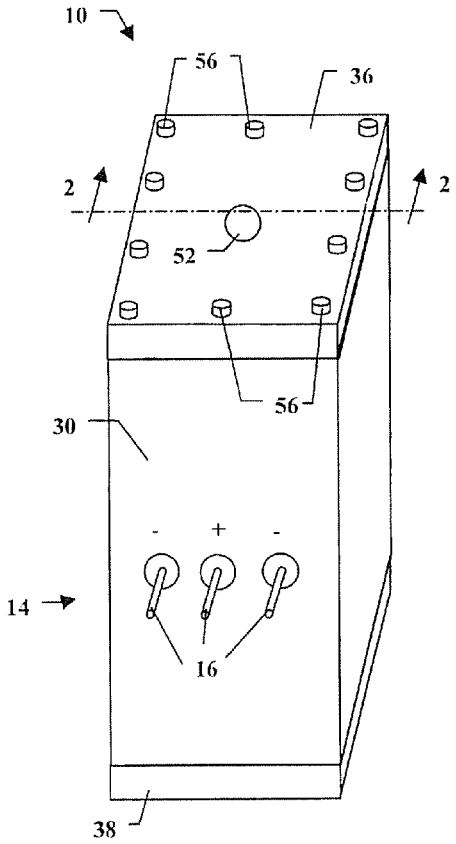
FIG. 1 is a schematic perspective view of an electrolytic cell according to an embodiment of the present invention.
Figure 2:
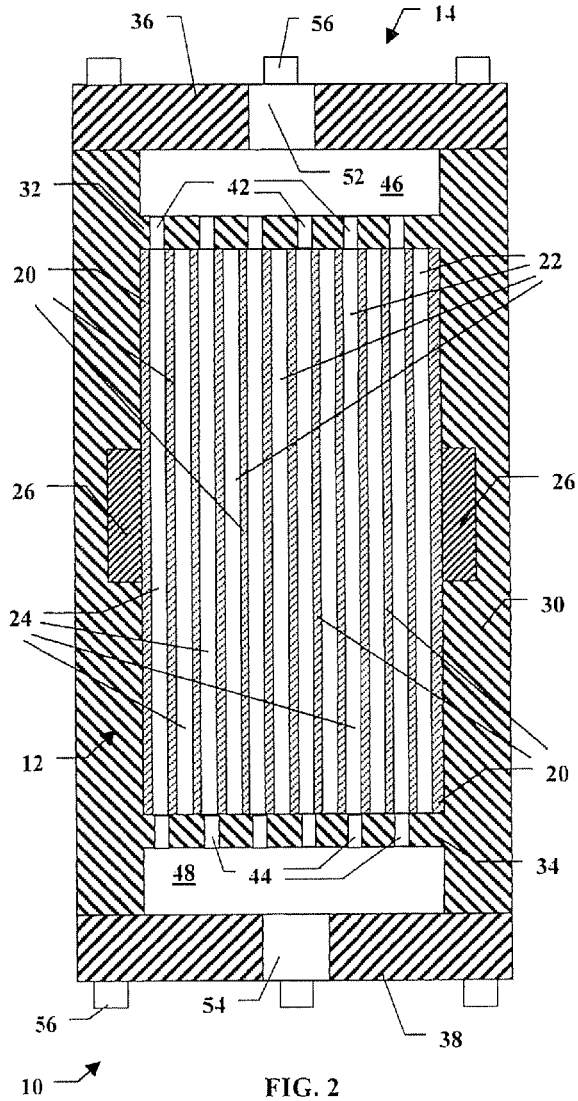
FIG. 2 is a sectional view of the electrolytic cell taken along line 2-2 of FIG. 1.

Referring to FIGS. 1 and 2, according to an embodiment of the present invention, an electrolytic cell 10 includes a plate stack 12 and a housing 14. A plurality of terminals 16 extend through the housing 14 and are connected with the plate stack 12 to allow an electric potential to be applied across the plate stack 12 when the terminals 16 are connected to a power supply.

The plate stack 12 includes a plurality of plates 20 spaced apart to define a plurality of channels 22 therebetween. A plurality of adhesive strips 24 are arranged between the plates 20 and further define the channels 22. A pair of permanent magnets 26 are arranged on opposite sides of the plate stack 12.

The housing 14 includes an outer housing 30, first and second manifold sections 32, 34, and first and second end caps 36, 38. A plurality of first and second manifold openings 42, 44 are defined in the respective first and second manifold sections 32, 34 in communication with the channels 22. First and second plenums 46, 48, in communication with the respective first and second manifold openings 42, 44, are defined between the respective first and second manifold sections 32, 34 and first and second end caps 36, 38.

First and second end cap openings 52, 54 are defined in the respective first and second end caps 36, 38 and communicate with the channels 22 via the respective first and second plenums 46, 48 and first and second manifold openings 32, 34. The first and second end caps 36, 38 are preferably secured to the outer housing 30 by a plurality of machine screws 56, as well as adhesive.

Preferably, the plates 20 are made from an electrically conductive metal and the housing 14 is formed of an electrically insulative material, such as a hard-cured urethane. Advantageously, the housing 14 substantially surrounds the perimeter of each plate 20, effectively preventing shorting between edges of the plates 20 to ensure that current passing between the plates 20 passes through electrolyte in the channels 22. The adhesive strips 24 are preferably two-sided pressure-sensitive tape, such as is readily available from the 3M corporation.

Also, the manifold sections 32, 34 allow the electrolyte to be introduced and gas to exit the channels 22 while minimizing the chances of shorting at outer edges of the plates 20. Additionally, the manifold sections 32, 34 facilitate the retention of the electrolyte under pressure in the channels 22, reducing the size of gas bubbles formed and increasing effective plate coverage by the electrolyte.

The magnets 26 have also been found to slightly increase the efficiency of electrolysis within the cell 10. It is believed that this efficiency increase is due to the better alignment of magnetic forces generated when an electric potential is applied across the plate stack 12. For the cell 10 with the terminals 16 shown, a preferred polarity for each of the magnets 26 is, with reference to FIG. 2, the south pole to the left and the north pole to the right.

Figure 3:
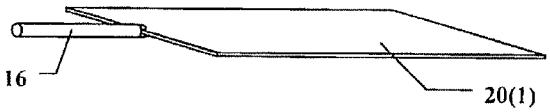
FIG. 3 is a schematic perspective view of a stage of assembly of the electrolytic cell of FIG. 1.
Figure 4:
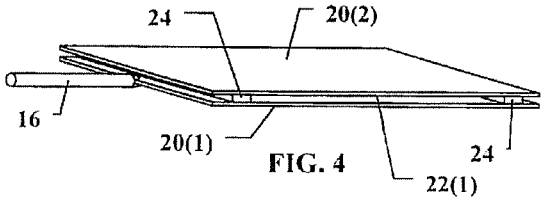
FIG. 4 is a schematic perspective view of another stage of assembly of the electrolytic cell of FIG. 1.

A method of making an electrolytic cell will be described with reference to FIGS. 1-11. Referring to FIGS. 3 and 4, the first plate 20(1) is attached to the second plate 20(2) using the adhesive strips 24. The plates 20 and adhesive strips 24 define the first channel 22(1). The first plate 20(1) has one of the terminals 16 pre-connected thereto.

Figure 5:
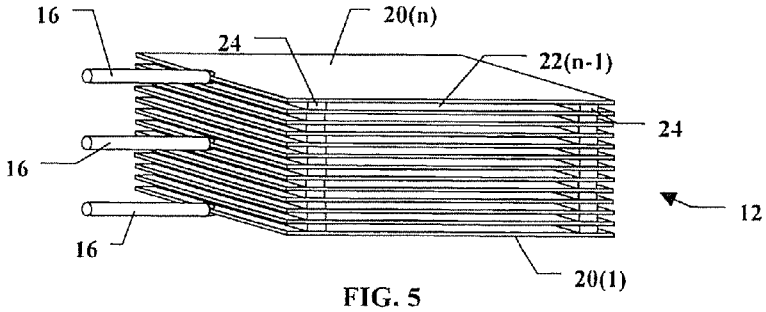
FIG. 5 is a schematic perspective view of a further stage of assembly of the electrolytic cell of FIG. 1.

Referring to FIG. 5, attachment of plates 20 using adhesive strips 24 is repeated until a desired last plate 20($n$) is in place forming a desired last channel 22($n$−1). The plate stack 12 thus formed is readily transportable for additional assembly steps without the need to worry about misalignments developing between the plates 20, or the plate stack 12 coming apart.

The last plate 20($n$) also has another of the pre-connected terminals 16. A third terminal 16 is connected to a middle plate 20 in the stack. The terminal 16 configuration shown allows an equal voltage potential to be applied across each half of the stack 12. For example, 12 volts DC could be applied to the central terminal, such that there would be 12 volt potential from the middle plate to the first plate and from the middle plate to the last plate.

It will be appreciated that the present invention is not necessarily limited to this terminal 16 configuration. For example, the central terminal could be omitted, or simply not connected, and voltage could be applied from the first plate to the last plate. For example, 24 volts DC could be applied across entire plate stack 12, which would yield a per plate voltage drop roughly similar to the previously described three terminal, 12 volts DC connection. The present invention, however, is not necessarily limited to a particular voltage, and the plate stack can be readily dimensioned according to the requirements of a given electrolysis application.

Figure 6:
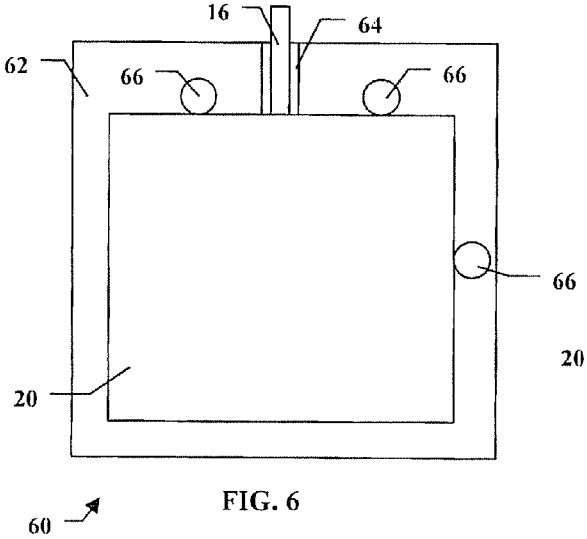
FIG. 6 is a top plan view of an apparatus used in the assembly of the electrolytic cell of FIG. 1.

Referring to FIG. 6, to facilitate proper alignment of the plates 20 during stacking, a plate stacking guide assembly 60 can be employed. The plate stacking guide 60 includes a base 62 upon which the plates 20 are stacked. A notch 64 is defined in the base 62 to accommodate the terminal 16 from the first plate 20(1) in the stack 12. Guide posts 66 extend from the base 62 and the plates 20 are abutted against them to set the desired alignment.

Figure 7:
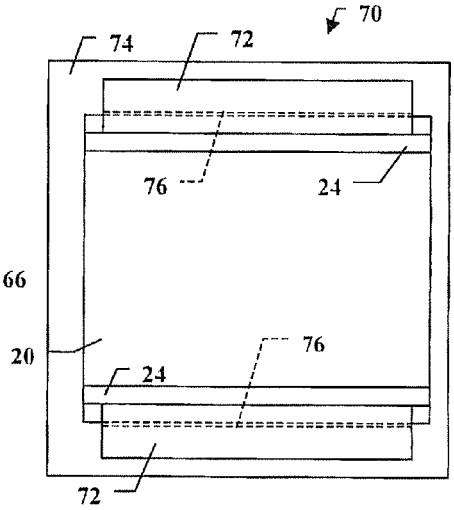
FIG. 7 is a top plan view of another apparatus used in the assembly of the electrolytic cell of FIG. 1.

Referring to FIG. 7, to facilitate placement of the adhesive strips 24 on the plates 20, a strip placement guide assembly 70 can be employed. The assembly 70 includes plate guide blocks 72 attached to a base 74. A single plate 20 is narrowly accommodated through guide slots 76 defined between edges of the guide blocks 72 and the base 74. The adhesive strips 24 are then attached to the plate 20 abutting respective guide blocks 72. Thus, the desired placement of the adhesive strips 24 on the plates 20 can be quickly and easily fixed, ensuring greater uniformity in the dimensions of the channels 22.

Figure 8:
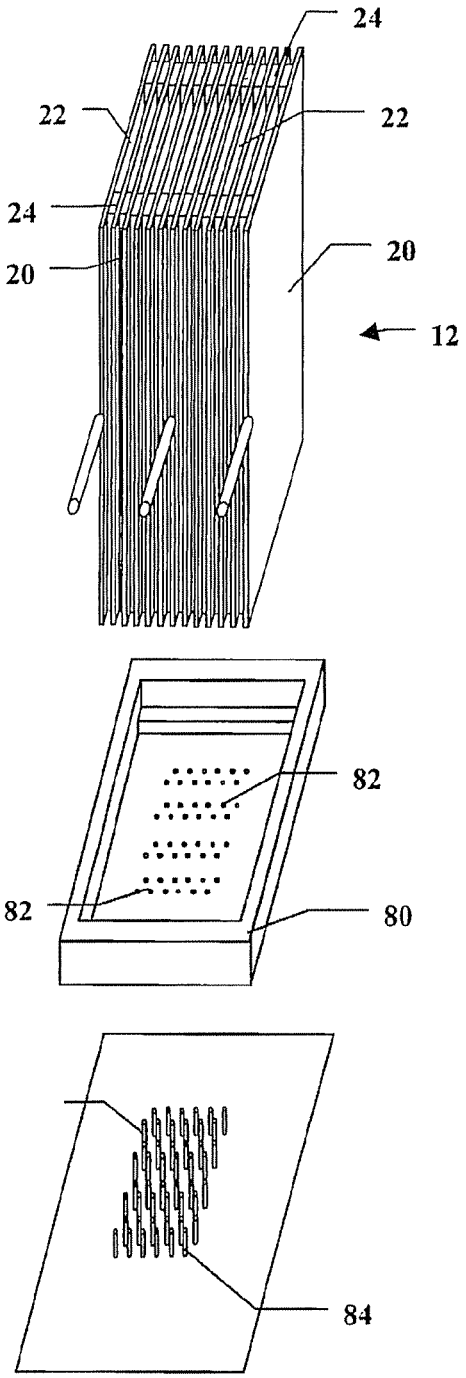
FIG. 8 is a schematic perspective view of an additional stage of assembly of the electrolytic cell of FIG. 1.
Figure 9:
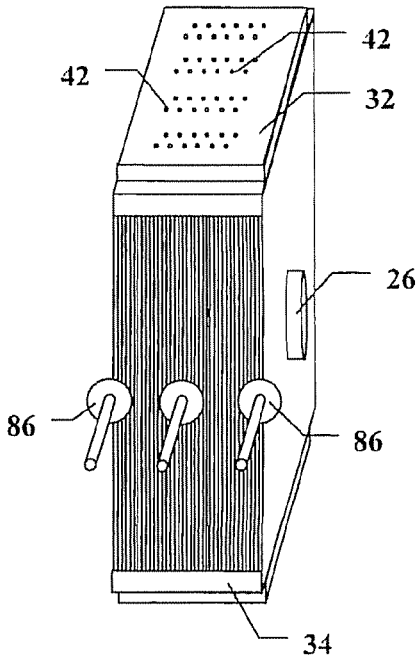
FIG. 9 is a schematic perspective view of another stage of assembly of the electrolytic cell of FIG. 1.

Referring to FIGS. 8 and 9, to form the first manifold section 32, a manifold section mold 80, having a plurality of manifold section openings 82 defined therein, is placed over a plurality of pins 84. The manifold section openings 82 and pins 84 are aligned such that the pins 84 sealingly extend through the manifold openings 82.

An end of the plate stack 12 is then fitted into the mold 80 such that the pins 84 extend into the channels 22. The mold 80 is then filled with a flowable material, for example a flowable urethane solution, which is cured to form the first manifold section 32. The plate stack 12 and mold 80 are removed from the pins 84 and the mold 80 is removed. Preferably, the mold 80 is formed from a flexible material, such as a silicone-based material.

To form the second manifold section 34, the plate stack 12 is turned over and the foregoing steps are repeated. Some finishing of the molded surfaces can be performed as desired or required. The permanent magnets 26 are then affixed to the sides of the plate stack 12. Nuts 86 are also placed around the terminals 16.

It will be appreciated that the pins 84 and the adhesive strips 24 cooperate to maintain the desired spacing between the plates 20 during molding of the first and second manifold sections 32, 34, with the volume vacated by removal of the plate stack 12 from the pins 84 defining the manifold openings 42, 44. The resulting combination plate stack 12 and manifold sections 32, 34 presents a substantially rigid assembly that is easily moved and handled for subsequent assembly steps.

Figure 10:
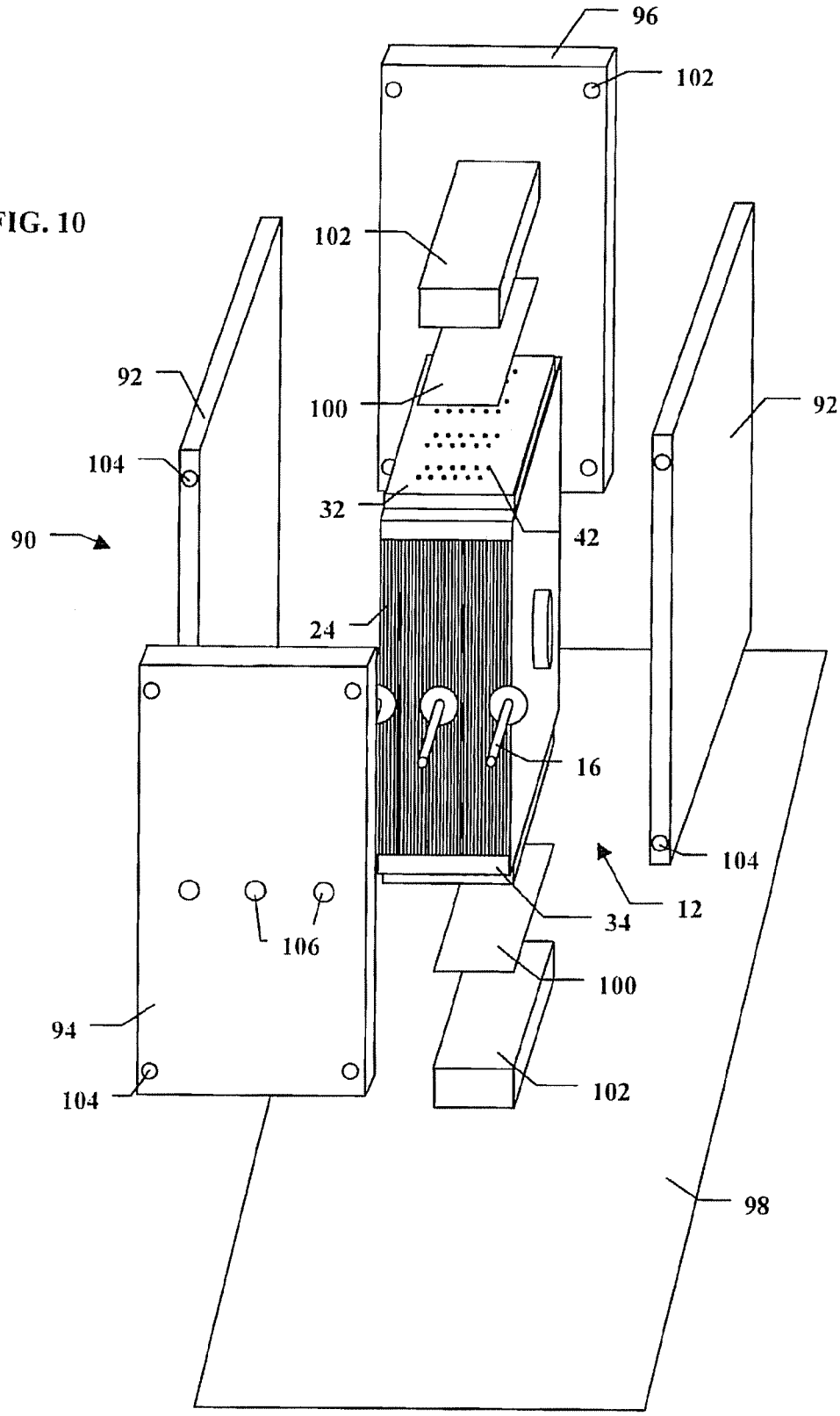
FIG. 10 is a schematic perspective view of a further stage of assembly of the electrolytic cell of FIG. 1.

Referring to FIG. 10, the plate assembly 12 with manifold sections 32, 34 is then placed into an outer housing mold assembly 90. The outer housing mold assembly 90 includes side panels 92 and front and rear panels 94, 96 that sit on a common base 98. To prevent the manifold openings 42, 44 of the first and second manifold sections 32, 34 from becoming fouled when the outer mold assembly 90 is filled, the manifold sections 32, 34 are covered with tapes 100 and blocks 102.

The adhesive strips 24 prevent fouling of the channels during molding. Advantageously, the adhesive strips 24 are sufficiently porous to be partially impregnated during molding, becoming securely bonded to the outer housing 30.

Prior to molding, the panels 92-96 are secured together, preferably by machine screws in threaded openings 104. The front panel 94 is further provided with terminal openings 106, through which the terminals 16 extend. Once secured together, the outer mold assembly 90 is filled with additional flowable material, preferably the same urethane solution used for the manifold sections 32, 34. The material is allowed to cure and the outer mold assembly 90, blocks 102 and tapes 100 are removed. Some finishing of the molded surfaces can again be performed as desired or required.

Figure 11:
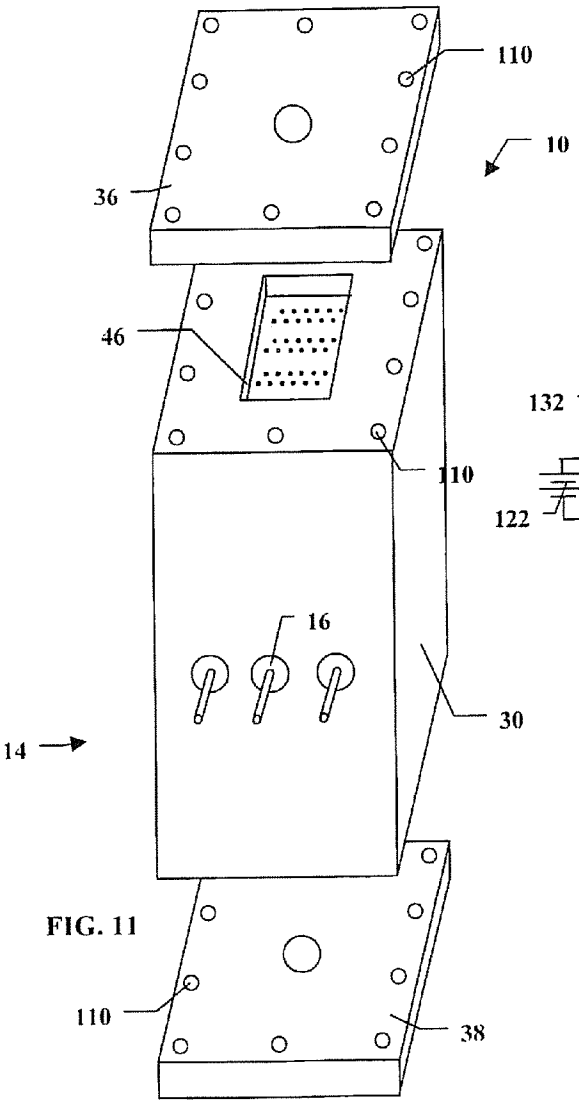
FIG. 11 is a schematic perspective view of an additional stage of assembly of the electrolytic cell of FIG. 1.

Referring to FIG. 11, it will be appreciated that the first and second plenums 46, 48 are formed in the volume vacated by removal of the blocks 102. The first and second end caps 36, 38 are aligned on the outer housing 30. Preferably, a plurality of threaded openings 110 are then tapped through the end caps 36, 38 into the outer housing 30. Referring again to FIG. 1, the end caps 36, 38 are then secured to the outer housing 30 by adhesive and the plurality of machine screws 56.

It will be appreciate that the foregoing method advantageously allows a rugged and robust electrolytic cell to be formed quickly and easily with acceptable tolerances and several advantageous features.

Figure 12:
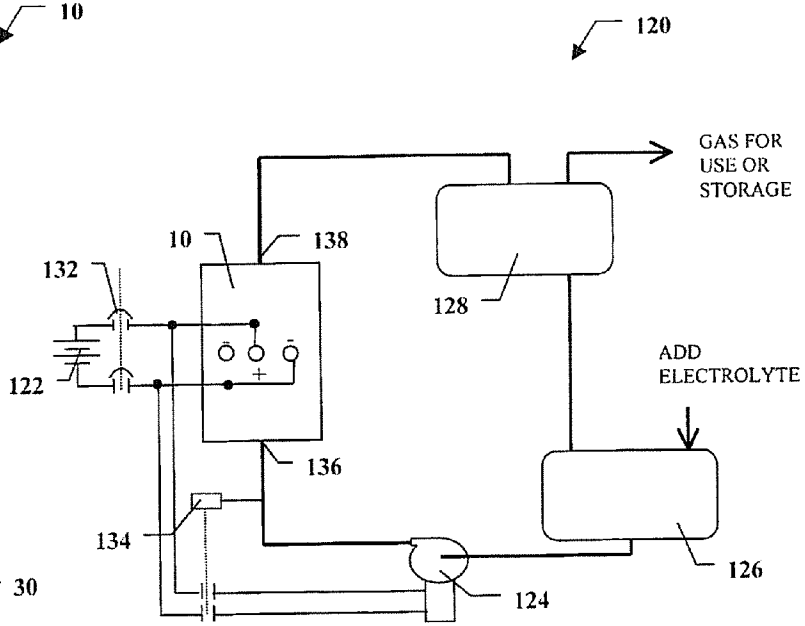
FIG. 12 is a schematic overview of an electrolysis system, according to another embodiment of the present invention, including the electrolytic cell of FIG. 1.

While those skilled in the art will appreciate that an electrolytic cell 10 formed according to the present invention can be put to use in a wide variety of electrolysis applications, the cell 10 has been found particularly advantageous for the electrolysis of water. Referring to FIG. 12, the electrolytic cell 10 can be used an electrolysis system 120, according to another embodiment of the present invention. In addition to the cell 10, the system 120 includes a power supply 122, a pump 124, an electrolyte storage tank 126 and a gas separation tank 128.

In operation a master switch or breaker 132 is closed to energize the cell 10. A pressure switch 134 senses pressure at an inlet 136 of the cell 10 and selectively energizes the pump 124 to supply electrolyte from the storage tank 126 to maintain a predetermined pressure. Gas evolved from the cell 10, such as oxyhydrogen gas in the electrolysis of water, leaves the cell via an outlet 138 and enters separation tank 128. Any fluid entrained in the gas eventually drains to the storage tank 126, and substantially dry gas leaves for use or storage. For instance, in the case of the electrolysis of water, the oxyhydrogen gas could be stored and/or used for use in welding torches or as a combustion aid in internal combustion motors.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described, and of the claims appended hereto.

What is claimed is:

1. A method of making an electrolytic cell, the method comprising:

arranging a manifold section mold having a plurality of openings therein over a plurality of pins such that the plurality of pins extend through the plurality of openings;

arranging a first end of a plate stack in the mold such that the plurality of pins extend into a plurality of channels defined between a plurality of plates of the plate stack;

filling the manifold section mold with a flowable material;

curing the flowable material to form a first manifold section on the first end of the plate stack; and removing the first end of the plate stack and first manifold section from the plurality of pins and the manifold section mold.

2. The method of claim 1, further comprising:

re-arranging the manifold section mold over the plurality of pins such that the plurality of pins extend through the plurality of openings;

arranging a second end of the plate stack in the mold such that the plurality of pins extend into the plurality of channels;

re-filling the manifold section mold with additional flowable material;

curing the additional flowable material to form a second manifold section on the second end of the plate stack; and removing the second end of the plate stack and second manifold section from the plurality of pins and the manifold section mold.

3. The method of claim 1, further comprising:

covering the first manifold section;

arranging the plate stack in a outer housing mold;

filling the outer housing mold with further flowable material;

curing the further flowable material to form an outer housing around the plate stack and first manifold section;

removing the plate stack, first manifold section and outer housing from the outer housing mold.

4. The method of claim 3, wherein covering the first manifold section includes arranging a block over the first manifold section and the outer housing is molded around the block such that a first plenum is defined is a volume vacated when the block is removed.

5. The method of claim 4, further comprising attaching an end cap to the outer housing such that an end cap opening is in communication with the first plenum.

6. The method of claim 1, further comprising:

forming the plurality of plates into the plate stack using a plurality of adhesive strips connected therebetween, the plurality of channels being defined between the plates and the adhesive strips.

7. The method of claim 6, wherein the plurality of adhesive strips cooperate to keep the further flowable material from entering the channels during molding of the outer housing.

8. The method of claim 7, wherein the further flowable material partially impregnates the adhesive strips prior to curing.

* * * * *